US005798177A

United States Patent [19]

Jansson

[11] Patent Number: 5,798,177

[45] Date of Patent: Aug. 25, 1998

[54] HEAT TREATING OF MAGNETIC IRON POWDER

[75] Inventor: Patricia Jansson, Viken, Sweden

[73] Assignee: Höganäs AB, Höganäs, Sweden

[21] Appl. No.: 722,049

[22] PCT Filed: Apr. 24, 1995

[86] PCT No.: PCT/SE95/00445

§ 371 Date: Oct. 11, 1996

§ 102(e) Date: Oct. 11, 1996

[87] PCT Pub. No.: WO95/29490

PCT Pub. Date: Nov. 2, 1995

[30] Foreign Application Priority Data

Apr. 25, 1994 [SE] Sweden ..... 9401392

[51] Int. Cl.[6] ..... B22B 5/16

[52] U.S. Cl. ..... 428/403; 148/104; 148/105; 427/127

[58] Field of Search ..... 148/104, 105; 428/403; 427/132

[56] References Cited

U.S. PATENT DOCUMENTS

| | | | |
|---|---|---|---|
| 4,155,748 | 5/1979 | Steck et al. | 148/105 |
| 4,165,232 | 8/1979 | Jaeckh et al. | 148/105 |
| 4,295,879 | 10/1981 | Steck et al. | 148/105 |
| 4,344,791 | 8/1982 | Steck et al. | 148/105 |
| 4,601,765 | 7/1986 | Soileau et al. | 148/104 |

FOREIGN PATENT DOCUMENTS

| | | |
|---|---|---|
| 0 434 669 | 6/1991 | European Pat. Off. . |
| 0 609 803 | 8/1994 | European Pat. Off. . |
| 0 619 584 | 10/1994 | European Pat. Off. . |
| 3439397 | 1/1990 | Germany . |

*Primary Examiner*—John Sheehan

*Attorney, Agent, or Firm*—Burns, Doane, Swecker & Mathis, LLP

[57] ABSTRACT

The invention concerns a method of compacting and heat-treating iron powders in order to obtain magnetic core components having improved soft magnetic properties. The iron powder consists of fine particles which are insulated by a thin layer having a low phosphorous content. According to the invention, the compacted iron powder is subjected to heat treatment at a temperature between 350° and 550° C.

22 Claims, No Drawings

HEAT TREATING OF MAGNETIC IRON POWDER

This invention relates to a method of heat-treating iron powders. More particularly, the invention relates to a method in which iron composites are moulded and pressed. The pressed components are then heat treated. The method is particularly useful to make magnetic core components having improved soft magnetic properties.

Iron-based particles have long been used as a base material in the manufacture of structural components by powder metallurgical methods. The iron-based particles are first moulded in a die under high pressures in order to produce the desired shape. After the moulding step, the structural component usually undergoes a sintering step to impart the necessary strength to the component.

Magnetic core components have also been manufactured by such power metallurgical methods, but the iron-based particles used in these methods are generally coated with a circumferential layer of insulating material.

Two key characteristics of an iron core component are its magnetic permeability and core loss characteristics. The magnetic permeability of a material is an indication of its ability to become magnetized or its ability to carry a magnetic flux. Permeability is defined as the ratio of the induced magnetic flux to the magnetising force or field intensity. When a magnetic material is exposed to a rapidly varying field, the total energy of the core is reduced by the occurrence of hysteresis losses and/or eddy current losses. The hysteresis loss is brought about by the necessary expenditure of energy to overcome the retained magnetic forces within the iron core component. The eddy current loss is brought about by the production of electric currents in the iron core component due to the changing flux caused by alternating current (AC) conditions.

Magnetic core components are made from laminated sheet steel, but these components are difficult to manufacture to net shape for small intricate parts and experience large core losses at higher frequencies. Application of these lamination-based cores is also limited by the necessity to carry magnetic flux only in the plane of the sheet in order to avoid excessive eddy current losses. Sintered metal powders have been used to replace the laminated steel as the material for the magnetic core component, but these sintered parts also have high core losses and are restricted primarily to direct current (DC) operations.

Research in the powder metallurgical manufacture of magnetic core components using coated iron-based powders has been directed to the development of iron powder compositions that enhance certain physical and magnetic properties without detrimentally affecting other properties. Desired properties include a high permeability through an extended frequency range, high pressed strength, low core losses and suitability for compression moulding techniques.

When moulding a core component for AC power applications, it is generally required that the iron particles have an electrically insulating coating to decrease core losses. The use of plastic coating (see U.S. Pat. No. 3,935,340 to Yamaguchi) and the use of doubly-coated iron particles (see U.S. Pat. No. 4,601,765 to Soileau et al) have been employed to insulate the iron particles and therefore reduce eddy current losses. However, these powder compositions require a high level of binder, resulting in decreased density of the pressed core part and, consequently, a decrease in permeability. Moreover, although the strength of pressed parts made from such powder compositions would generally be increased by sintering, the desired end-utility of the parts precludes such a processing step: the elevated temperatures at which sintering of the core metal particles normally occurs would degrade the insulating material and generally destroy the insulation between individual particles by forming metallurgical bonds.

In brief the present invention provides a method of making a component having improved magnetic properties by compacting or die-pressing a powder composition of insulated particles of an atomized or sponge iron powder optionally in combination with a thermosetting resin and subsequently subjecting the compacted composition to heat treatment at a temperature preferably not more than 500° C.

DE 34 39 397 discloses a method for a powder metallurgical preparation of soft magnetic components. According to this method iron particles are enveloped by an insulating phosphate layer. These particles are then compacted and subsequently heated in an oxidizing atmosphere. Before the compacting step the phosphate insulated iron particles are optionally mixed with a resin, preferably an epoxy resin. In order to obtain low hysteresis losses heating temperatures above 500° and below 800° C. are recommended. Furthermore this heat treatment should preferably be carried out stepwise with alternating reduced and normal or increased pressures and with stepwise increased temperatures for different periods of times. The advantages of this known process are experimentally disclosed for a heat treatment wherein the final step is carried out at a temperature of at least 600° C.

In view of this teaching it was quite unexpected to find that a remarkable improvement of the soft magnetic properties is obtained if the heat treatment is carried out at a temperature well below 600° C. According to the present invention it is thus critical that the heat treatment is carried out at a temperature between 350° and 550° C., preferably between 400° and 530° C. and most preferably between 430° and 520° C. Furthermore there is no need for alternating pressures and stepwise increasing temperatures as is recommended in the known process. The period of heat treatment according to the present invention is not critical and usually this period could vary between 20 minutes and 2 hours. Essentially the same improvements are obtained when heating for 0.5 h as when heating for 1 h. Furthermore and in contrast to the process disclosed in DE 34 39 397 the present invention can be carried out with a phosphorous acid treatment without any environmentally detrimental organic solvents.

Another feature of this known invention is that the phosphate insulating layer should constitute between 0.1 and 1.5% by weight of the iron particles. As discussed below the insulating "P-layer" is an important feature also for the present invention, according to which lower amounts of P are used.

More specifically the method according to the invention comprises the following steps.

Particles of an atomized or sponge iron powder are treated with an aqueous phosphoric acid solution to form an iron phosphate layer at the surface of the iron particles. The phosphorous acid treatment is preferably carried out at room temperature and for a period of about 0.5 to about 2 hours. The water is then evaporated at a temperature of about 90° to about 100° C. in order to obtain a dry powder. According to another embodiment the phosphoric acid is provided in an organic solvent such as acetone.

The phosphorous layer should be as thin as possible and at the same time insulate the separate particles as completely as possible. Thus the amount of phosphorus must be higher for powders with a larger specific surface area. As sponge powders have a higher specific surface area than atomized powders, the amount of P should generally be higher for sponge powders than for atomized powders. In the first case the P amount may vary between about 0.02 and 0.06, preferably between 0.03 and 0.05 whereas in the latter case the P amount might vary between 0.005 and 0.03, preferably between 0.008 and 0.02% by weight of the powder. It was quite unexpected that the very thin-insulating layer, which is characterized by a very low P-content could withstand the heat-treatment according to the invention without degradation.

The dried P-coated powder could optionally be mixed with a thermosetting resin. This is particularly the case if it is required that the final component should have relatively high tensile strength. According to a preferred embodiment a phenol-formaldehyde resin is used as thermosetting resin. An example of a commercially available thermosetting resin is Peracit® from Perstorp Chemitec, Sweden. The resin particles which preferably should have a fine particle size are mixed with the P-coated iron powders. When Peracit® is used curing temperatures of about 150° C. are convenient, and the curing period might be about an hour.

Before the compacting step the P-coated iron powder or the P-coated iron powder containing the resin is mixed with a suitable lubricant. Alternatively, the die is lubricated. The amount of lubricant should be as low as possible. One type of lubricant which is useful according to the present invention is Kenolube® available from Höganäs AB, Sweden, which can be used in an amount of 0.3–0.6% by weight of the powder. The compacting step is carried out in conventional equipment, usually at ambient temperature and at pressures between about 400 and 1800 MPa.

In the final heat-treatment step the compacted mixture is subjected to a temperature between 350° and 550° C. Preferably the temperature varies between 420° and 530° C. and most preferably between 430° and 520° C. The heat treatment is preferably carried out in one step but alternatively the resin might be cured at the recommended curing temperature in a first step. For phenol-formaldehyde of the type discussed above the curing temperature is about 150° C. and the curing period about an hour.

The invention is illustrated in the following examples.

EXAMPLE 1

Sponge iron powder and atomized powder were treated with aqueous phosphoric acid to form a phosphate layer on the surface. After drying the powder was mixed with 0.5% Kenolube and/or resin and compacted in a die at 800 MPa to form toroids with outer diameter 5.5 cm, inner diameter 4.5 cm and height 0.8 cm. The component was then heated at 150° C., alternatively 500° C., for 60(30) minutes in air.

Materials operating at high frequency i.e. above 1 kHz require high permeability (μ), eddy current loss causes a rapid depletion of permeability with increasing frequency. Insulated iron powder cores can be produced with permeability values ranging from very low up to 90 at a frequency of 5 kHz. The use of heat treatment, according to this invention, to increase the permeability while maintaining an effective insulation layer for minimum eddy current losses results in permeability values as high as 130 at 5 kHz as illustrated in Table 1.

TABLE 1

| Temperature | Sponge <150 μm +0.5% Peracit +0.5% Kenolube | Sponge <150 μm +0% Resin +0.5% Kenolube | Atomized <150 μm +0.5% Peracit +0.5% Kenolube |
|---|---|---|---|
| 150° C. | μ at 5% kHz = 75 | μ at 5 kHz = 77 | μ at 5 kHz = 73 |
| 500° C. | μ at 5% kHz = 115 | μ at 5 kHz = 130 | μ at 5 kHz = 100 |
| 600° C. | | μ at 5 kHz = 42 | |

The use of small particle size iron powder will extend the frequency range for which a stable permeability is achieved. A constant permeability of 100 is maintained at 25 kHz when the particle size of the iron powder is reduced to <40 μm.

The total loss is considerably reduced by the heat treatment procedure. In contrast to the conventional material of laminated steel the total loss of the insulated powder is dominated by hysteresis loss which is relatively high at low frequency. However due to the heat treatment, the hysteresis loss is decreased. As the insulation layer is surprisingly not degraded by the heat treatment the eddy current loss remains low. At higher frequency a large eddy current loss will result in a considerable increase in total loss. As illustrated in Table 2 the heat treatment reduces the hysteresis loss of the insulated powder resulting in a total loss of 13 W/kg for the atomized grade compared with 14 W/kg for the conventional laminated steel.

TABLE 2

| Ref Conventional Laminated Steel 1018 | Temperature | Sponge <150 μm + 0% Peracit + 0.5% Kenolube | Atomized <150 μm + 0.5% Peracit + 0.5% Kenolube |
|---|---|---|---|
| $P_{1.5/50}$ = 14 W/kg | 150° C. | $P_{1.5/50}$ = 25 W/kg | $P_{1.5/50}$ = 20 W/kg |
| | 500° C. | $P_{1.5/50}$ = 20 W/kg | $P_{1.5/50}$ = 15 W/kg or 13 W/kg without resin |
| | 600° C. | $P_{1.5/50}$ = 27 W/kg | |

The use of large particle size iron powder is known to result in high permeability values. Insulation of the particles reduces the total loss. The use of heat treatment, according to this invention, on insulated iron powder with a particle size of >150 μm results in a low total loss of $P_{1.5/50}$=13 W/kg fully comparable with that achieved with <150 μm particles. However the maximum permeability of the >150 μm powder is 500 compared to 400 when the particle size is <150 μm.

At higher frequency the dominant eddy current loss in the conventional material will increase the total loss at a faster rate with increasing frequency. Surprisingly the heat treatment has not caused the insulation layer to disintegrate causing metal to metal contact. The low eddy current loss of the insulated material results in lower total loss with increasing frequency. This is illustrated by the example in Table 3 where the low eddy current loss of the insulated powder results in a total loss of 65 W/kg for the atomized grade after heat treatment. The high eddy current loss of the conventional laminated steel results in a total loss of 115 W/kg at 1000 Hz and 0.5 Tesla—a result which exceeds that of the insulated powder heat treated at 150° C.

TABLE 3

| Ref Conventional Laminated Steel 1018 | Sponge <150 μm + +0.5% Peracit +0.5% Kenolube | Atomized <150 μm +0.5% Peracit +0.5% Kenolube |
|---|---|---|
| | 150° C. | 500° C. |
| $P_{0.5/1000}$ = 115 W/kg | $P_{0.5/1000}$ = 100 W/kg | $P_{0.5/1000}$ = 75 W/kg or 65 W/kg without resin |

EXAMPLE 2—Comparison Between the Process According to the German Patent 3 439 397 and the Present Invention A water atomized iron powder ABC 100.30, available from Höganäs AB, Sweden was subjected to treatment with phosphoric acid and dried as described in example 1 of the patent. After drying for 1 h at 100° C., the powder was compacted at 800 MPa and the compacted product was heated at 500° C. for 30 minutes.

The obtained product was compared with a product prepared according to the present invention. This product was prepared from the same base powder ABC 100.30, but subjected to a phosphoric acid treatment such that the P-content was 0.01% by weight. This was achieved by subjecting the powder to an 1.85% aqueous orthophosphoric acid solution which was added to the iron powder in a quantity of 8 ml/kg and mixed for 1 minute. The obtained mixture was dried at 100° C. for 60 minutes and the powder was compacted at 800 MPa and the compacted product was heated at 500° C. for 30 minutes in air. It is not clarified if the insulating layer actually is made up of phosphate. However, the layer is extremely thin and, so far, not identified as to chemical composition. A comparison disclosed that measured properties, such as flow, green strength and density, were superior for the product according to the present invention.

The following is a comparison of the magnetic properties total losses and permeability:

| Total losses | |
|---|---|
| product according to DE patent | product according to present invention |
| P 0.5T/1000 Hz = 88 W/kg | P 0.5/1000 Hz = 75 W/kg |
| P 1.5T/1000 Hz = 850 W/kg | P 1.5/1000 Hz = 700 W/kg |
| Permeability μ at $H_{max}$ and 50 Hz/0.5T | |
| 160 | 320 |

The P-contents of the powder according to the DE patent and according to the present invention were 0.206 and 0.013 respectively.

The above comparison discloses that the process according to the present invention, which, as compared with the process according to the German patent, is simplified, requires less energy and is environmentally advantageous and results in products having superior properties.

I claim:

1. A process for the preparation of products having improved soft magnetic properties comprising the following steps a) treating particles of an atomized or sponge iron powder with phosphoric acid at a temperature and for a time sufficient to form an insulating phosphorous containing layer material such that the phosphorus content is between 0.005 and 0.03% by weight of the atomized iron powder and between 0.02 and 0.06% by weight of the sponge iron powder, b) drying the obtained powder, c) optionally mixing the dry powder with a thermosetting resin, d) compacting the powder obtained from step b) or c) in a die, and e) heating the component obtained from step d) to a temperature between 350°–550° C.

2. The process according to claim 1, wherein the phosphorus content of the atomized powder obtained from step a) is between 0.008 and 0.02% by weight and between 0.03 and 0.05% by weight for the sponge powder obtained from step a).

3. The process according to claim 1, wherein the temperature in step e) varies between 400° and 530° C.

4. The process according to claim 1, wherein the thermosetting resin is phenolformaldehyde.

5. The process according to claim 1, wherein the particles of the atomized or sponge iron powder are treated with aqueous phosphoric acid.

6. The process according to claim 5, wherein the resin is added in an amount of 0.1–0.6% by weight of the iron powder.

7. The process according to claim 1, wherein an additional heating step is carried out at the curing temperature of the resin before the final heating step e).

8. The process according to claim 7, wherein the additional heating step is carried out at a temperature between 120° C. and 160° C.

9. The process according to claim 1, wherein the compacting step is carried out at ambient temperature.

10. The process according to claim 1, wherein a lubricant is added to the powder before the compacting step.

11. The process according to claim 1, wherein the iron particles have an average particle size of about 10 to 200 μm.

12. The process according to claim 1, wherein the heating step is carried out for a period of between 20 minutes and 2 hours.

13. The process according to claim 1, wherein the phosphoric acid treatment is carried out at ambient temperature for a period of about 0.5 to about 2 hours and the powder obtained is dried at a temperature of about 90° to about 100° C.

14. Iron powder for preparation of products having improved soft magnetic properties, the powder consisting essentially of particles of atomized or sponge iron powder having an insulating layer, the layer on the atomized iron powder comprising between 0.005 and 0.03% by weight of phosphorus and the layer on the sponge iron powder comprising between 0.02 and 0.06% by weight of phosphorus.

15. The process according to claim 2, wherein the temperature in step e) varies between 400° and 530° C.

16. The process according to claim 2, wherein the thermosetting resin is phenolformaldehyde.

17. The process according to claim 2, wherein the particles of the atomized or sponge iron powder are treated with aqueous phosphoric acid.

18. The process according to claim 2, wherein an additional heating step is carried out at the curing temperature of the resin before the final heating step e).

19. The process according to claim 2, wherein the compacting step is carried out at ambient temperature.

20. The process according to claim 2, wherein a lubricant is added to the powder before the compacting step.

21. The process according to claim 3, wherein the temperature in step e) varies between 430° and 520° C.

22. The process according to claim 15, wherein the temperature in step e) varies between 430° and 520° C.

* * * * *